US006368418B1

(12) United States Patent
Rowe

(10) Patent No.: US 6,368,418 B1
(45) Date of Patent: Apr. 9, 2002

(54) PIPELINE CLEANING TOOL AND A METHOD OF CLEANING PIPELINES

(76) Inventor: William H. Rowe, 407 S. Sunland St., Ridgecrest, CA (US) 93555

( * ) Notice: Subject to any disclaimer, the term of this patent is extended or adjusted under 35 U.S.C. 154(b) by 0 days.

(21) Appl. No.: 09/620,611

(22) Filed: Jul. 20, 2000

(51) Int. Cl.[7] ..... B08B 9/055

(52) U.S. Cl. ..... 134/8; 15/104.061

(58) Field of Search ..... 15/3.5, 104.061, 15/104.063; 134/8

(56) References Cited

U.S. PATENT DOCUMENTS 2,609,556 A * 9/1952 Carver ..... 15/104.061
5,617,604 A 4/1997 Erich

* cited by examiner

*Primary Examiner*—Randall E. Chin
(74) *Attorney, Agent, or Firm*—Charles H. Thomas

(57) ABSTRACT

A pipeline cleaning tool is constructed with an elongated support mechanism having a rigid cutting unit mounted at one end and a folding propulsion assembly mounted at the other end. The propulsion assembly includes a system of folding sector panels that are hinged to a central hub for rotation relative thereto about tangential axes of rotation. A separate expansion flap is secured to each sector panel for rotation relative thereto about a radially oriented axis of rotation by a hinged connection to one radial side edge. Each expansion flap partially overlaps the upstream face of the sector panel immediately adjacent to that upon which it is mounted. The area of overlap is controlled by the extent to which the sector panels of the propulsion unit are folded back toward the supporting shaft. The greater the extent of folding, the greater will be the area of overlap of each expansion flap upon the upstream face of an adjacent sector panel. A disc-shaped backing seal is employed immediately adjacent the sector panels and the expansion flaps against the upstream faces thereof. A pressure differential is thereby formed across the propulsion unit which propels the cleaning tool along a section of pipeline to be cleaned. Radially projecting teeth and, in some cases, longitudinally projecting blades, slice through and break up accumulated clogging material that adheres to the inside of the pipeline wall as the pipeline cleaning unit is forced through the pipeline by pressure against the upstream side of the propulsion unit. The distance of radial projection of the teeth of the cutting unit may be made adjustable.

20 Claims, 8 Drawing Sheets

PIPELINE CLEANING TOOL AND A METHOD OF CLEANING PIPELINES

BACKGROUND OF THE INVENTION

1. Field of the Invention

The present invention relates to a tool and method for cleaning deposits, scale and other buildup on the inside surfaces of pipelines.

2. Description of the Prior Art

Petroleum, geothermal, sewage, and other pipelines utilized to conduct fluids often develop buildups of deposits, scale, and other materials on the inner wall surfaces of the pipes that make up the pipeline. Continued buildup of accretions on the walls of a pipeline reduces the volume of fluid that flows through the pipeline and increases the resistance to flow through the line. Eventually the opening through the center of the pipeline decreases in cross-sectional area to such a degree that cleaning of the pipeline is imperative in order for it to continue to be useful for the conduction of fluids.

In conventional practice, maintenance to unclog pipelines in which clogging deposits can be scoured by water alone may be performed by creating an opening in a pipeline and inserting a cleaning hose into the opening. The hose is directed toward a remote end of the section of pipeline to be cleaned. A cleaning liquid ejection nozzle is located at the end of the pipeline cleaning hose and is equipped with jets that are directed rearwardly back from the end of the hose. To clean the pipeline, the operative end of the cleaning hose that bears the jetting nozzle is inserted through the pipeline opening and into the pipeline. Water under pressure is then pumped through the hose. This water is emitted from the rearwardly directed jets at the operating end of the cleaning hose from the cleaning ejection nozzles. The water discharged through the jets is thereby directed back along the pipeline toward the opening through which these cleaning hose is inserted.

The jets of water under pressure ejected from the hose nozzle serve to propel the operating, ejection end of the cleaning hose further along the pipeline, away from the opening. Also, the jets scour the walls of the pipeline as the operating end of the hose is propelled along the pipeline. The pipeline cleaning hose is wound on a large hose spool or reel located near the opening in the pipeline. As the operating end of the cleaning hose propels itself along the pipeline, additional lengths of cleaning hose are fed off of the reel to permit the operating end of the cleaning hose to continue to travel along the pipeline, going ever further from the access opening.

In other situations the nature of the buildup on the interior walls of the pipeline is such that the application of water pressure alone is entirely inadequate to dislodge the accumulated build up. For example, the buildup of minerals and compounds on the inside of pipelines used in geothermal applications can rarely be removed by water pressure alone. A much heavier-duty pipeline cleaning system is required in such situations.

One conventional heavy-duty pipeline cleaning system that is currently in use to clean geothermal pipelines is operated by EP & Associates, located in California. This system involves a tool having a plurality of notched discs of increasing diameter mounted on its forward, or downstream end, and also radially outwardly directed rollers also located on the downstream end. On its upstream end the EP & Associates' tool employs a steel disc that has a plurality of short fingers or fins located about its periphery. This disc with its hinged fingers provides a backing for a disc-shaped Kevlar® seal located upstream therefrom.

The EP & Associates' pipeline cleaning tool also has significant operating problems. It requires a very high operating pressure, typically between five hundred and six hundred pounds per square inch of water to exert a force against the upstream surface of the Kevlar® disc to propel the tool through the pipeline. Also, this tool is subject to extreme damage as it advances through a clogged pipeline. It can typically be utilized to clean only about six hundred linear feet of a fourteen inch diameter pipeline before it must be rebuilt. Also, the pipeline has to be cut frequently since the tool becomes so degraded that it will not travel far before becoming hopelessly lodged in a pipeline having a heavy build up of clogging accretions.

SUMMARY OF THE INVENTION

The present invention involves a rugged pipeline cleaning tool that is constructed quite differently from prior pipeline cleaning tools and which has very important operating advantages. The pipeline cleaning tool of the present invention, like the EP & Associates' tool, is propelled by the application of water pressure to the upstream sealing face of the tool. Unlike the EP & Associates' tool, however, the pipeline cleaning tool of the invention requires an operating water pressure about 120–180 psi. This reduction in water pressure is possible due to the unique construction of the folding propulsion system. Furthermore, the pipeline cleaning tool of the invention can clean over two thousand feet of clogged, twenty inch diameter pipe before requiring any refurbishment of components. Also, the pipeline cleaning tool of the invention is able to clean pipe throughout a much greater range of diameters without requiring disassembly and reassembly of different components than has heretofore been possible. Moreover, when it is necessary to install larger diameter components on the tool, the disassembly and reassembly process takes only about ten minutes.

The pipeline cleaning tool of the invention is relatively simple in construction, yet is highly durable. Also, it requires far less time and manpower to operate than conventional pipeline cleaning tools.

In one broad aspect the invention may be considered to be a pipeline cleaning tool comprising: an elongated support member; a rigid cutting unit; a folding propulsion assembly; a rotation limiting barrier; and a backing seal. The elongated support member has opposing first and second ends. The rigid cutting unit has a periphery, preferably with cutting teeth thereon, and is secured proximate the first end of the support member. The cutting unit projects radially outwardly from the support member. The folding propulsion assembly includes a hub, a plurality of sector panels, and expansion flaps. The hub is secured to the support member proximate the second end thereof. The sector panels are arranged about the periphery of the hub and are each hinged separately thereto for rotation independently of each other about axes tangentially oriented relative to the periphery of the hub. Each of the sector panels has opposing upstream and downstream faces and first and second side edges. The side edges of the sector panels diverge radially outwardly from each other. In this way the sector panels fan radially outwardly from the hub and define gaps therebetween.

An expansion flap is provided for each of the sector panels. The expansion flaps extend the lengths of the first side edges of the section panels and are hinged thereto. In this way the expansion panels bridge the gaps and overlap portions of the upstream faces of the sector panels immediately adjacent the sector panels to which they are hinged. The rotation limiting barrier is anchored to the elongated support member to prevent rotation of the sector panels past the hub in one direction of rotation relative thereto, and to permit free rotation of the sector panels relative to the hub in an opposite direction relative thereto. The backing seal is a disc-shaped structure formed of a flexible, water impervious material and anchored to the elongated support member on a side of the hub opposite the rotation limiting barrier.

The cutting unit may be formed of a flat, disc-shaped metal plate serrated at its outer periphery to form radially projecting cutting teeth. In many instances it is necessary to propel the cleaning tool of the invention through a section of pipe to be cleaned several times if the build up on the interior pipe wall is quite hard. This is because only a portion of the buildup can be removed in a single pass. When several passes of the tool through the pipeline are necessary, a serrated metal cutting disc of increased diameter can be substituted for the serrated disc employed in the previous pass in order to increase the central opening cleared by the tool with each successive pass through the section of pipeline to be cleaned.

In an alternative arrangement, the rigid cutting unit may have an adjustable cutting diameter. One way of making the diameter of the cutting unit adjustable is to form the unit with a pair of cutter element mounting discs mounted coaxially relative to the support member. Each of the cutter elements mounting discs has a plurality of angularly spaced mounting openings defined therethrough near its periphery. The mounting openings in the mounting discs are radially and longitudinally aligned with each other.

A plurality of flat cutting elements are located between the mounting discs and project radially outwardly therefrom. Each cutting element has a relatively wide outer end with cutting teeth defined at the outer periphery thereon and a relative narrow inner end with a radially elongated mounting opening defined therethrough. Clamping bolts extend through the mounting openings to hold the cutting elements firmly in place between the mounting discs. The cutting elements thereby project radially outwardly from the mounting discs an adjustable, selected distance from the elongated support member.

In another aspect the invention may be considered to be a pipeline cleaning tool comprising: an elongated central shaft having opposing first and second ends; a rigid cutting unit secured proximate the first end of the shaft; a propulsion unit secured proximate the second end of the shaft; a rotation barrier anchored to the shaft; and a backing seal.

The cutting unit extends radially outwardly from the shaft and preferably defines cutting teeth at its radial periphery. The propulsion units includes: a solid hub secured proximate the second end of the shaft; a plurality of sector panels projecting radially outwardly from the hub; and a separate expansion flap for each of the sector panels. The sector panels are independently hinged to the hub for rotation about axes tangential to the hub. Each of the sector panels has radially outwardly diverging first and second side edges. The expansion flaps are hinged for independent rotation along the first side edges of the sector panels.

The rotation barrier projects outwardly radially beyond the hub. The rotation barrier limits rotation of the sector panels relative to the hub toward only one of the ends of the shaft. The expansion flaps slide in overlapping contact with adjacent sector panels when the sector panels rotate toward the shaft and away from the one end of the shaft toward which the rotation barrier limits rotation. Together the hub, the sector panels, the expansion flaps, and the backing seal present a transverse obstruction in the pipeline to fluid flow past the shaft in a single longitudinal direction relative thereto.

In still another aspect the invention may be considered to be a method of cleaning a section of pipeline having an interior bounded by a cylindrical annular wall upon which clogging deposits have formed. The method of the invention utilizes a pipeline cleaning tool of the type previously described. The method is comprised of several steps. First, openings are formed in the pipeline at both ends of the section of pipeline to provide access to the interior thereof. The pipeline cleaning tool is then inserted into the interior of the pipeline at one of the openings at one of the ends of the section of pipeline. The end of the pipeline section into which the tool is inserted may be considered to be the upstream end of the pipeline section. The cleaning tool is inserted into the upstream end so that the upstream faces of the sector panels face the upstream end of the pipeline section.

Fluid is forced under pressure into the upstream end of the section of pipeline so that the fluid exerts a force against the upstream faces of the sector panels and against the expansion flaps. This tends to rotate the sector panels outwardly toward the annular wall of the pipeline section to form a pressure differential on opposite sides of the backing seal. The pressure differential propels the pipe cleaning tool toward other end of the pipeline section. The teeth of the cutting unit dislodge the clogging deposits from the annular wall of the pipeline section as the tool travels along the length of the section. The pipeline cleaning tool is removed from the other of the openings in the pipeline.

In some circumstances the cleaning tool must be passed through the pipeline section several times in succession. In such circumstances the cutting unit employed preferably has an adjustment mechanism for varying the distance at which the teeth are held from the support member. When the cleaning is complete, the openings in the pipeline are closed.

The invention may be described with greater clarity and particularity with reference to the accompanying drawings.

DESCRIPTION OF THE EMBODIMENTS

Figure 1:
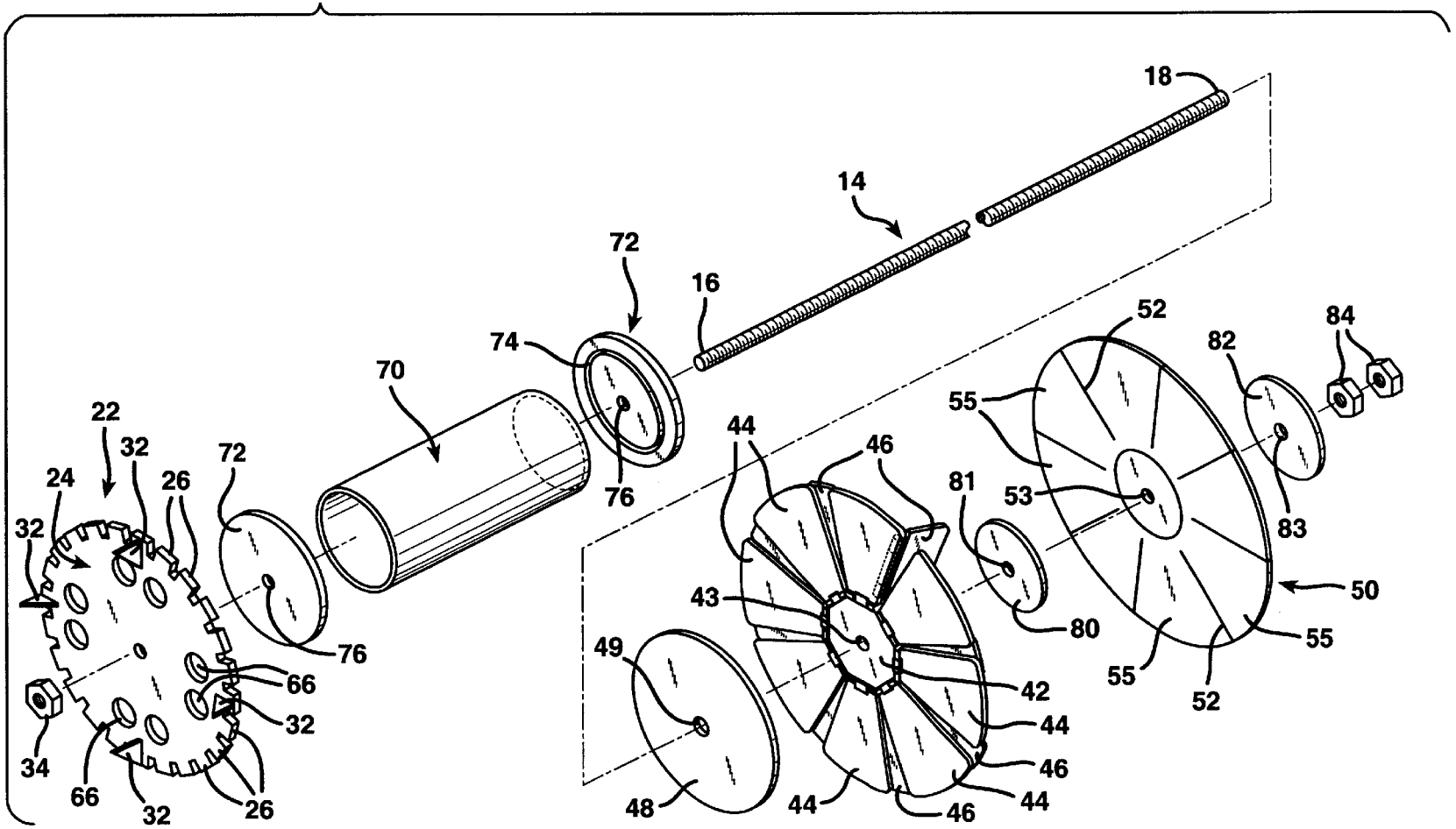
FIG. 1 is a perspective view of one embodiment of a pipeline cleaning tool according to the invention in which the cutting element of the tool has a fixed diameter.
Figure 2:
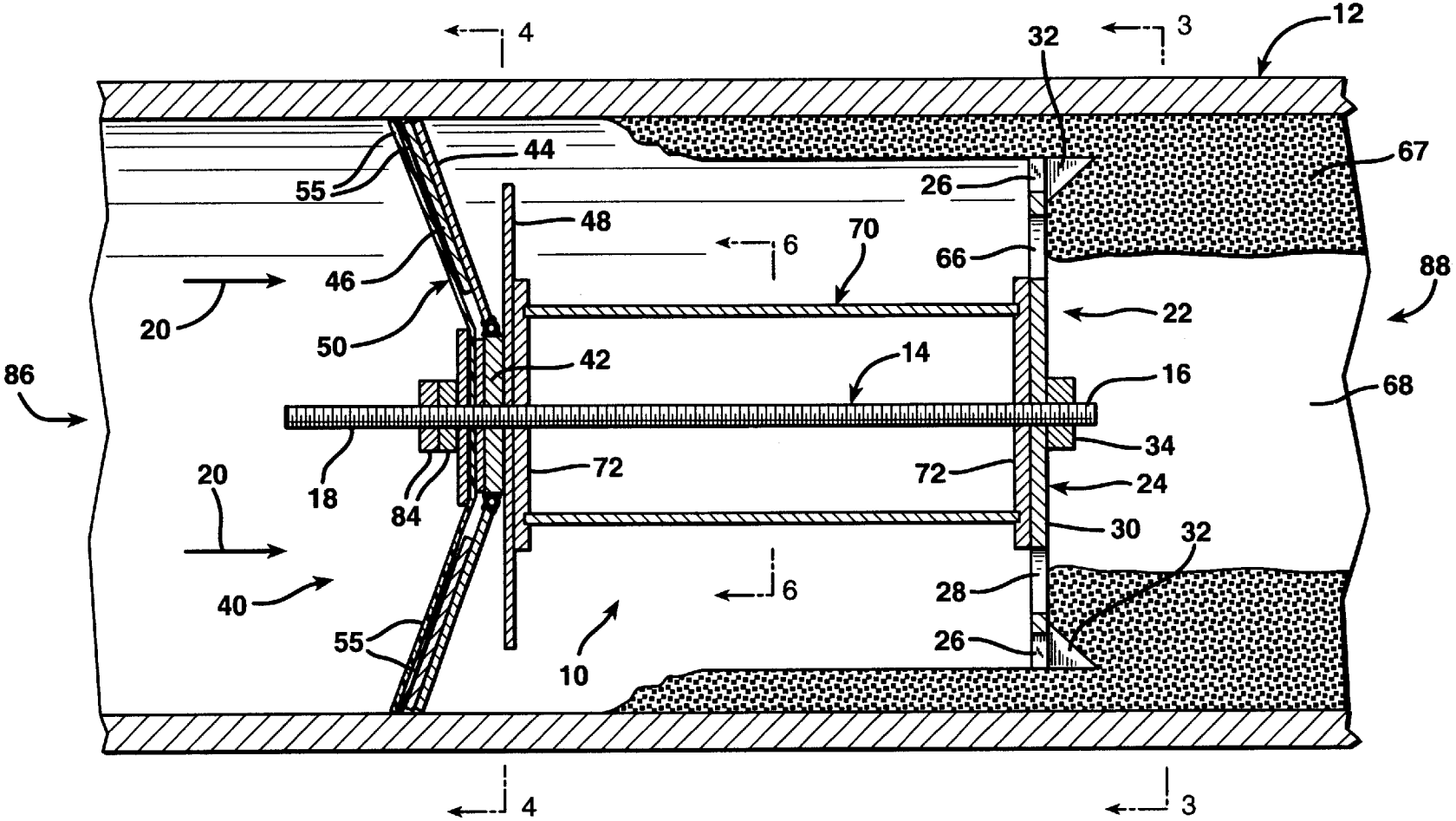
FIG. 2 is a side sectional elevational view illustrating the tool of FIG. 1 in use during cleaning of a section of pipeline.

FIGS. 1 and 2 illustrate a pipeline cleaning tool 10 which may, for example, be constructed in a size suitable for cleaning a section of pipeline 12 having an inner diameter of twenty inches in a single pass through the section of pipeline 12. The pipeline cleaning tool 10 is formed with an elongated, central shaft 14 which is a one and one-quarter inch diameter externally threaded steel B7 stud. The length of the shaft 14 is governed by the radius of bends which the pipeline 12 makes. It is desirable for the central shaft 14 to be as long as possible so as to maintain the cleaning tool 10 in longitudinal alignment within the pipeline 12. However, the pipeline cleaning tool 10 must be short enough so that it is capable of traveling through bends in the pipeline 12. In the geothermal industry, bends in pipelines 12 typically have a standard radius which is equal to one and a half times the interior pipe diameter. Therefore, for a twenty inch pipe the maximum length of the central shaft 14 is typically about thirty inches.

In the embodiment illustrated in FIGS. 1 and 2, the central shaft 14 has a first end 16, which in this embodiment is the downstream end, and an opposing second end 18, which is the upstream end. The flow direction in the pipeline 12 of water propelling the pipeline cleaning tool 10 is indicated by the directional arrows 20 in FIG. 2.

Figure 3:
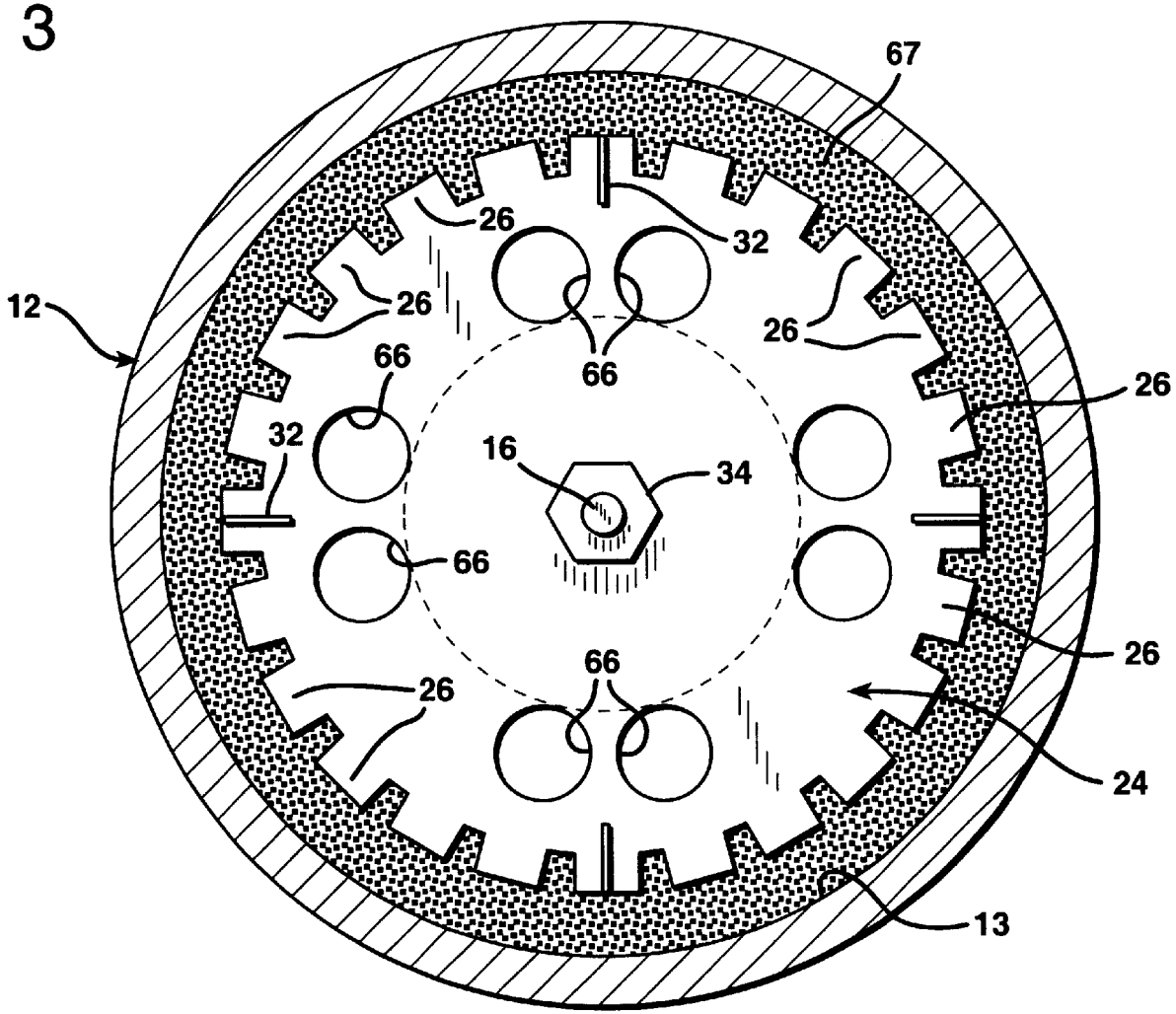
FIG. 3 is a transverse sectional elevational view taken along the lines 3—3 of FIG. 2.
Figure 4:
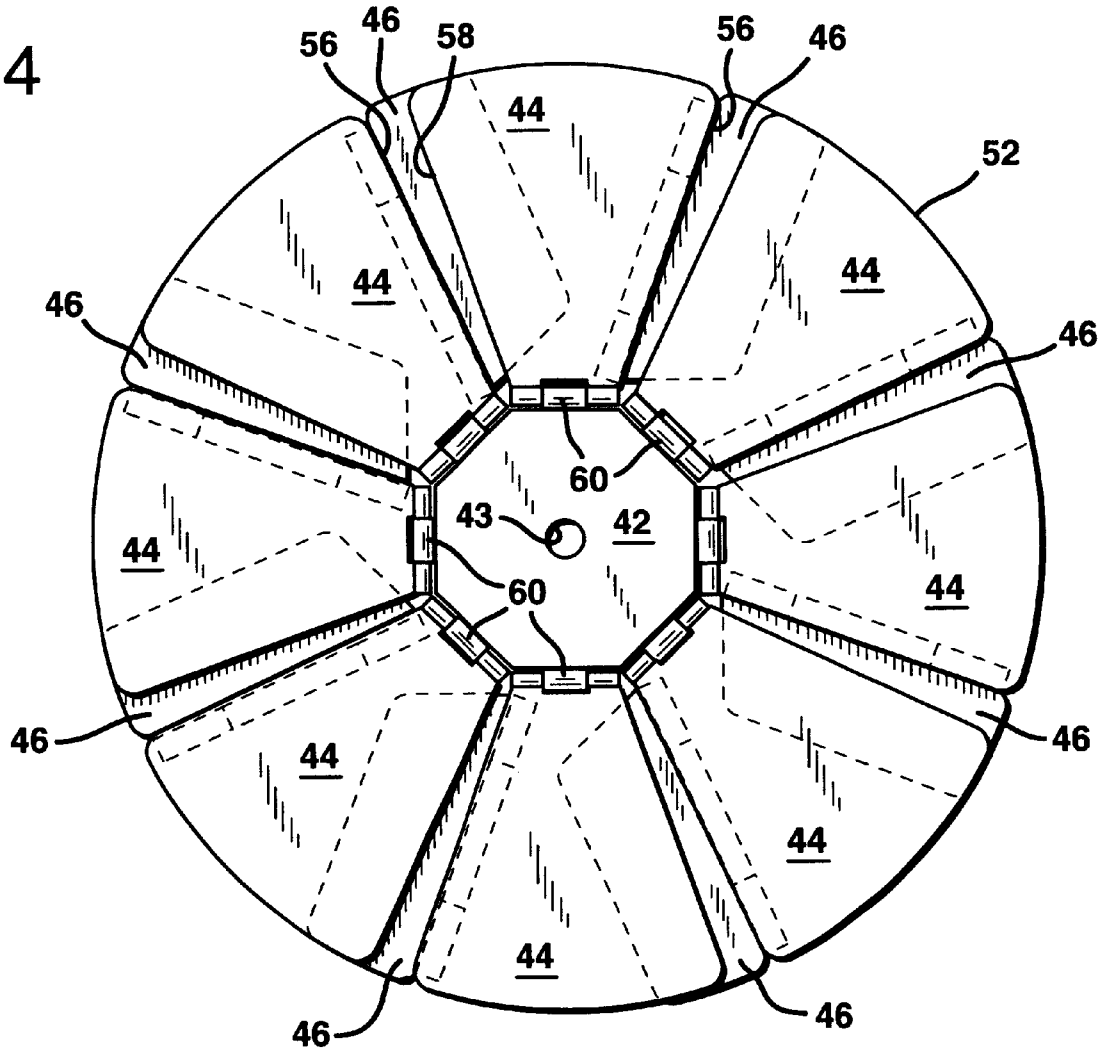
FIG. 4 is a transverse sectional elevational view taken along the lines 4—4 of FIG. 2.

A rigid cutting unit 22 is secured proximate the first end 16 of the shaft 14. In the embodiment depicted in FIGS. 1–7, a cutting element 22 of a single, fixed diameter is utilized. The cutting unit 22 is comprised of a full diameter steel cutting plate 24 which may, for example, have an outer diameter of only slightly less than twenty inches and a thickness of about one half of one inch. The rigid, flat, disc-shaped metal plate 24 is serrated at its periphery to form radially outwardly projecting cutting teeth 26, as illustrated in FIG. 3. The metal cutting plate 24 has an upstream face 28 and an opposite downstream face 30. The metal cutting plate 24 is held in position at its downstream face 30 by a retaining nut 34 that is threaded onto the first end 16 of the central shaft 14.

As illustrated in FIGS. 2 and 3, a plurality of sharp, triangular-shaped, longitudinally projecting blade-like projections 32 are mounted by welds on the downstream face 30 of the metal cutting disc 24 at equally spaced intervals near the periphery of the cutting disc 24. The points of the cutting blade projections 32 are aligned with the perimeter of the metal cutting disc 24 and the cutting edges of the blades 32 are inclined radially inwardly and back toward the structure of the metal cutting disc 24.

A propulsion unit 40 is located at the opposite end 18 of the shaft 14. The propulsion unit 40 includes a solid hub 42 secured proximate the second end 18 of the shaft 14, a plurality of solid, sector-shaped panels 44 projecting radially outwardly from the hub 42, and a separate, solid expansion flap 46 for each of the sector panels 44. A rotation barrier plate 48, and a backing sealing disc 50 formed of a flexible sheet of water-impervious material are located on the downstream and upstream sides of the propulsion unit 40, respectively.

The hub 42 has a central, circular opening 43 therethrough which allows the hub 42 to fit onto the central shaft 14. The outer perimeter of the hub 42 is formed as a regular polygon. In the embodiment illustrated in FIGS. 1–7 the hub 42 has an octagonal shape. Each of the eight sides at the perimeter of the hub 42 is about four inches in length. The sector panels 44 are formed as flat steel slabs about one-quarter of an inch thick and shaped as truncated sectors of a circle. Each sector panel 44 has a convex radial outer edge 52 and a shorter straight inner edge 54. The sector panels 44 also have radially outwardly diverging first side edges 56 and second side edges 58.

The sector panels 44 are independently hinged to the hub 42 by linear leaf hinge connections 60. The sector panels 44 are thereby independently hinged for rotation relative to the hub 42 about eight different axes lying long the outer side edges of the hub 42. The axes of rotation of the sector panels 44 relative to the hub 42 are all tangential to an imaginary circle inscribed within the hub 42 and touching each of the eight outer straight sides thereof.

Figure 5:
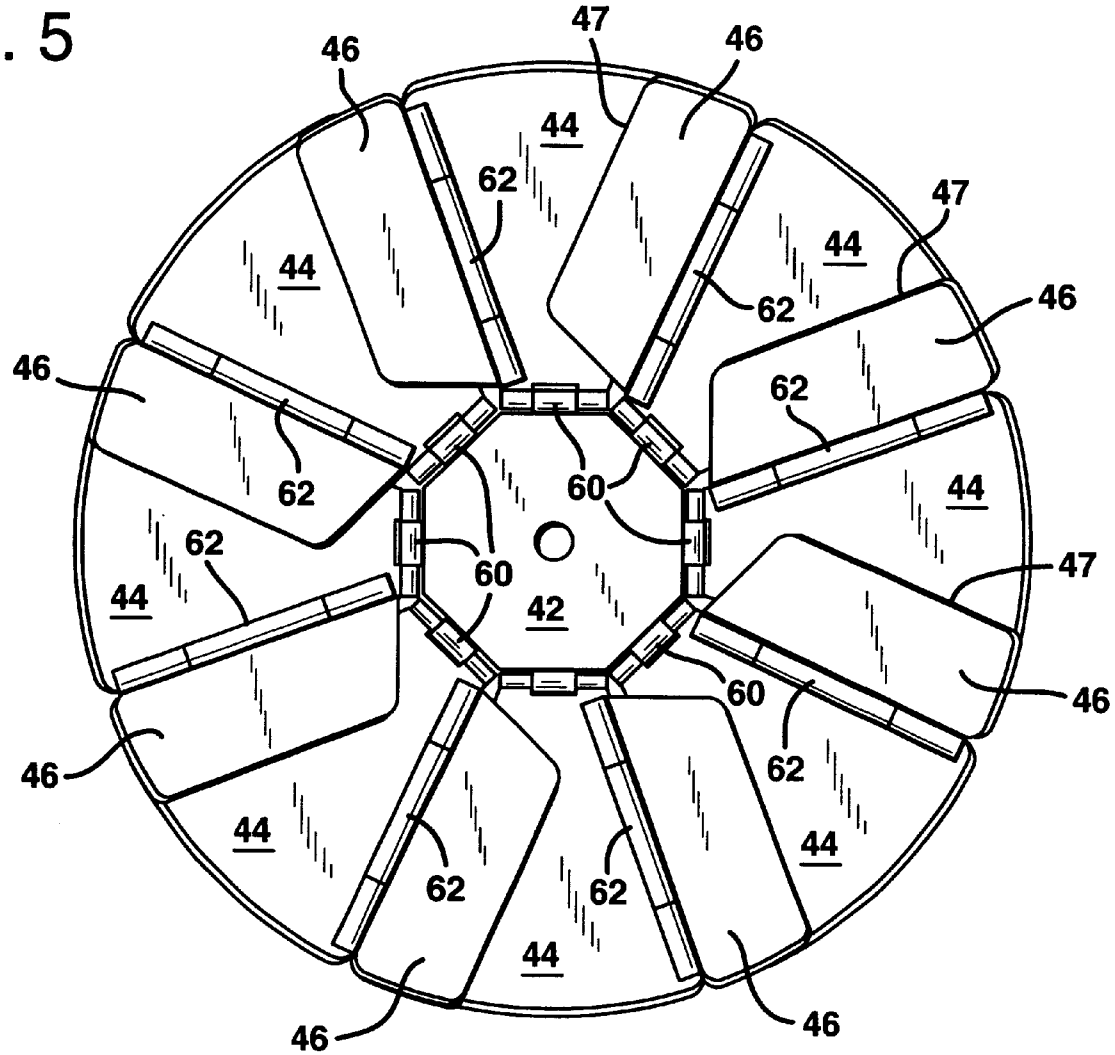
FIG. 5 is an elevational view of the hub, sector panels, and expansion flaps, shown in isolation from the remaining portion of the propulsion unit of FIGS. 1 and 2, viewed from the upstream side thereof.
Figure 6:
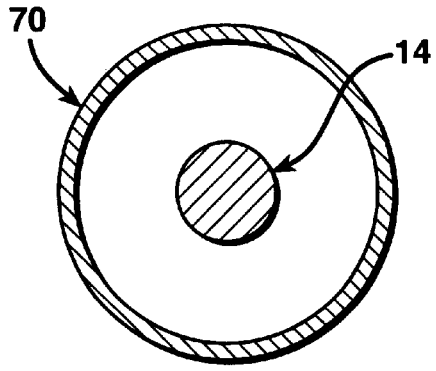
FIG. 6 is a sectional elevational detail taken along the lines 6—6 of FIG. 2.
Figure 7:
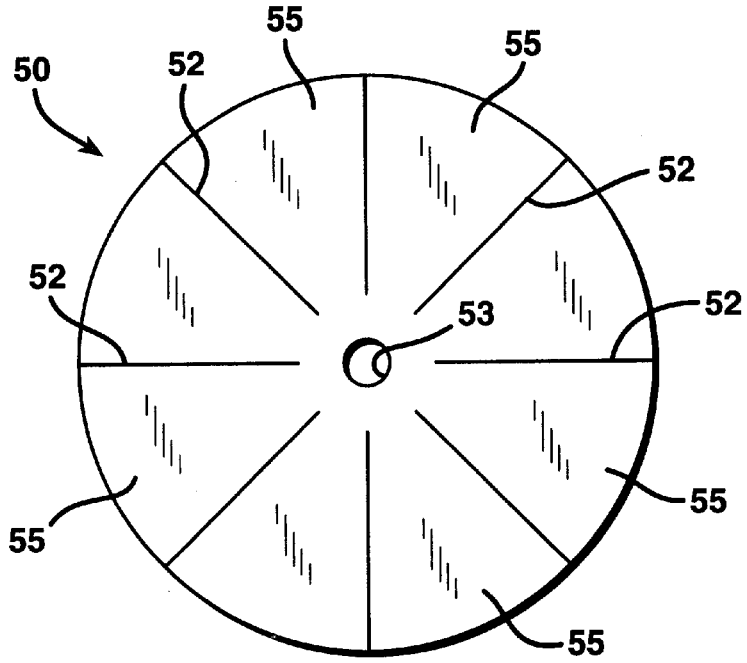
FIG. 7 is a transverse elevational view showing the seal of the propulsion unit of the pipeline cleaning tool of FIGS. 1 and 2 in isolation.

The expansion flaps 46 have a generally trapezoidal shape and are hinged for independent rotation along the first side edges 56 of the sector panels 44 at linear, radially oriented leaf hinge connections 62, as best illustrated in FIG. 5. A single expansion flap 46 is hinged to each sector panel 44 along the first side edge 56 thereon and extends behind the next adjacent sector panel 44 in contact with and overlapping a portion of the upstream face thereof.

The rotation barrier plate 48 is positioned on the shaft 14 immediately downstream from the propulsion unit 40. The rotation barrier plate 48 is a rigid, steel rotation disc having a diameter of about twelve inches and a central opening 49 therein to accommodate the shaft 14. The barrier plate 48 limits rotation of the sector panels 44 relative to the hub 42 in a longitudinal direction toward only one of the ends of the shaft 14, namely the downstream end 16. In the embodiments of FIGS. 1–7 the rotation barrier plate 48 limits rotation of the sector panels 44 in a downstream direction toward the first, downstream end 16 of the shaft 14, but permits free rotation of the sector panels 44 away from the downstream end 16 and the barrier plate 48 and toward the upstream end 18 of the shaft 14.

As illustrated in FIG. 1, gaps of a significant width exist between the adjacent sector panels 44 when the sector panels 44 have been rotated forwardly in a downstream direction to the maximum extent possible as permitted by the rotation barrier plate 48. At the limit of rotation in the downstream direction, the sector panels 44 reside in substantially coplanar alignment with the hub 42 and project radially outwardly therefrom. The expansion flaps 46 are wide enough to more than span the gaps that exist between the adjacent sector panels 44. When water is forced from the upstream end of the pipeline 12 downstream in the direction indicated by the directional arrows 20, the expansion flaps 46 are each pressed against the portions of the upstream faces of the sector panels 44 immediately adjacent to the sector panels 44 to which each of the expansion flaps 46 is attached.

The backing seal 50 is mounted on the shaft 14 immediately upstream from the propulsion unit 40. The backing seal 50 is formed of a disc of rubber one-half of an inch in thickness and extends radially outwardly the same distance as the sector panels 44. The rubber backing seal 50 is formed of the same rubber material that is often utilized in the fabrication of conveyor belts. The rubber backing seal 50 is mounted on the central s haft 14 proximate the hub 42 and on a side of the hub 42 opposite the rotation barrier plate 56. That is, the hub 42 is located between the barrier plate 56 and the backing seal 50 on the shaft 14.

The sealing disc 50 has radial slits 52 defined therein which extend inwardly from the periphery of the backing seal 50 a distance equal to the length of the side edges 56 and 58 of the sector panels 44. The slits 52 divide the outer peripheral portion of the lacking seal 50 into eight petal-shaped sections 55. The radial slits 52 defined in the backing seal disc 50 are angularly aligned with the gaps between the sector panels 44.

The pipeline cleaning tool 10 depicted in FIGS. 1–7 has a propulsion unit hub 42 with a periphery shaped as an octagon. There are therefore eight different sector panels 44 in the propulsion unit 40. The backing seal 50 therefore has eight radial slits 52 spaced at forty-five degree intervals and extending inwardly from the periphery of the backing sealing disc 50 and terminating about three inches from a central axial opening 53 in the backing seal disc 50. The central opening 53 is large enough to accommodate passage of the elongated central shaft 14. The slits 52 in the backing seal disc 50 are thereby both angularly and longitudinally aligned with the gaps that exist between the propulsion unit sector panels 44.

The propulsion unit 40 has the unique capability of folding a very considerable distance so that a pressure differential is created across the upstream and downstream sides of the backing seal 50 not only within different diameters of build up of scale and calcified deposits, indicated at 67 in FIGS. 2 and 3, but also within different diameters of pipeline 12. Together the hub 42, the sector panels 44, the expansion flaps 46, and the backing seal 50 extend radially outwardly from the central shaft 14 until encountering either the interior wall of the pipeline 12 or the radially inner surface of the clogging deposits 67 that line a clogged pipeline 12 which requires cleaning.

Furthermore, since there are a plurality of sector panels 44, and since each sector panel 44 is independently hinged to the hub 42, the different sector panels 44 are each folded or extended independently of all of the other sector panels 44 to the extent necessary to reach the surrounding pipeline wall or deposit layer 67. This allows the system to accommodate nonuniformities in the build up of the clogging deposits 67 about the inner circumference of the pipeline 12.

The sector panels 44 are capable of movement between extended positions oriented in substantially coplanar relationship with the hub 42 and perpendicular to the central shaft 14 to positions in which they are folded back in the upstream direction, opposite the directional arrows 20 depicted in FIG. 2, to reside at an angle of about forty degrees relative to the central shaft 14. The extreme outer edges of the sector panels 44 and the expansion flaps 46 can thereby fold from a maximum radial distance of nearly twenty inches from the axis of the central shaft 14 when the sector panels 44 reside in substantially coplanar relationship with the hub 42 to a distance of about thirteen and three-quarter inches from the axis of the shaft 14 when the sector panels are oriented at an angle of about forty degrees relative to the shaft 14 and at an angle of about fifty degrees from the plane in which the hub 42 lies.

When the sector panels 44 are oriented in substantially coplanar relationship with the hub 42, the edges 47 of the expansion flaps 46 remote from the hinges 62 that join the flaps 46 to the sector panels 44 at the first sector panel edges 56 just barely overlap the second edges 58 of the adjacent sector panels 44. As the sector panels 44 are folded inwardly toward the shaft 14, the width of the gaps between the adjacent sector panels 44 is reduced and the expansion flaps 46 slide across the upstream faces of the sector panels 44 immediately adjacent thereto. The propulsion unit 40 formed by the hub 42, the sector panels 44, and the expansion flaps 46 may thereby be folded from a structure that has a generally disc-shaped configuration to a structure that is shaped generally as a truncated cone. However, throughout its folding movement, the combined structure of the hub 42, the sector panels 44, and the expansion flaps 46 always presents a sturdy, rigid, longitudinally movable plug in the central opening in the pipeline 12. This obstruction to liquid flow is enhanced by the presence of the water-impermeable backing seal 50 which aids significantly in limiting liquid flow past the propulsion unit 40.

The hub 42, the sector panels 44, and the expansion flaps 46 form a rigid structure that resists the force of liquid flow and which protects the backing seal 50 from damage as the cleaning tool 10 travels along the section of pipeline 12. At the same time, the backing seal 50 limits the penetration of the propelling liquid past the propulsion unit 40. Without the sector panels 44 and the expansion flaps 46, the outer periphery of the backing seal 50 would simply collapse due to the force of liquid applied at the upstream end of the pipeline 12. With the sector panels 44 and the expansion flaps 46, together with the hub 42, a rigid structure is presented that resists the liquid force applied from the upstream end of the pipeline 12.

Of course the obstruction formed by the propulsion unit 40 and the backing seal 50 does not form a liquid-tight seal. There will always be a certain amount of liquid flow past the outer peripheries of the backing seal 50, the sector panels 44 and the expansion flaps 46. There will also be some leakage of liquid through the slits 52 and in between the expansion flaps 46 and the upstream faces of the sector panels 44 against which the expansion flaps 46 are pressed. Nevertheless, the structure of the propulsion unit 40 together with the backing seal 50 creates a very significant pressure differential between the upstream end of the cleaning tool 10 in the vicinity of the second, upstream end 18 of the shaft 14 and the downstream end of the cleaning tool in the vicinity of the first or downstream end 16 of the shaft 14.

In actuality, a certain amount of liquid flow past the rigid cutting unit 22 is quite desirable as long as a liquid pressure differential large enough to propel the tool 10 is maintained. As the hydraulic pressure of water applied from the upstream end of the pipeline 12 in the direction indicated by the directional arrows 20 acts against the propulsion unit 40, the pressure differential created in the pipeline 12 pushes the pipeline cleaning tool 10 longitudinally along the pipeline 12 from the upstream end toward the downstream end of the pipeline section to the cleaned. As the pipeline cleaning tool 10 travels, the radially projecting peripheral teeth 26 on the outer edge of the cutting disc 24 tear through the clogging build-up of deposits 67 that adhere to the inner wall of the pipeline 12, thereby breaking up these deposits and dislodging them from the pipeline wall. The water that does flow past the propulsion unit 40 carries these dislodged deposits downstream.

The efficiency of the cleaning action of the cleaning tool 10 is enhanced by the presence of the longitudinally projecting blades 32 located at the periphery of the downstream face 30 of the cutting disc 24. The blades 32 serve to slice through the deposits 67 and remove and break up these deposits. The location of the blades 32 at the outer periphery of the cutting disc 24 causes the sliced and cracked deposit material to be forced radially inwardly toward the center of the pipeline 12, where it can be carried downstream through the central, unclogged opening 68 within the surrounding deposits 67.

As illustrated in FIG. 3, the cutting disc 24 is preferably constructed with a plurality of openings 66 located a short distance radially inwardly from its toothed periphery. In the embodiment of the invention illustrated in FIGS. 1–7, two openings 66 are provided in the disc-shaped metal plate 24 proximate to each of the blades 32 on either side thereof. The openings 66 are preferably about one inch in diameter and are located in pairs on either side of the four deposit splitting and crushing blades 32. The openings 66 provide flow paths of low resistence through which the water that passes the propulsion unit 40 can flow. The hydraulic flow through the openings 66 serves to flush and carry away the particulate material of the deposits 67 as that material is split and crushed by the blades 32 and the teeth 26.

To enhance the rigidity of the pipeline cleaning tool 10, the elongated support mechanism of the cleaning tool 10 includes not only the one and one-quarter inch diameter threaded shaft 14 upon which the hub 42 and the cutting unit 22 are mounted, but also a small gauge, metal, cylindrical reinforcement tube 70 which is held in rigid, coaxial alignment concentrically about the shaft 14. The tube 70 is held in position by a pair of hard rubber alignment discs 72. The alignment discs 72 each have one flat face and an opposite face in which an annular alignment groove 74 is defined. The faces of the alignment disc 72 having the alignment grooves 74 defined therein are disposed in mutually facing relationship at the opposite ends of the reinforcement tube 70. The alignment discs 72 also have central axial openings 76 defined therethrough to accommodate the presence of the central shaft 14.

To assemble the pipeline cleaning tool 10, the elongated, threaded support shaft 14 is inserted through the central, axial opening 76 in one of the alignment discs 72 and through the axial center of the reinforcement cylinder 70. The other alignment disc 72 is then mounted on the central shaft 14 so that the circular end edges of the reinforcement cylinder 70 are seated in the grooves 74. The grooves 74 hold the reinforcement cylinder 70 in coaxial alignment relative to the shaft 14. The steel cutting disc 22 is next installed onto the downstream end 16 of the shaft 14. An extra heavy, internally threaded nut 34 is threadably advanced onto the downstream end 16 of the shaft 14.

At the opposite, upstream end 18 of the shaft 14, the rotation limiting barrier plate 48 is inserted onto the shaft 14, with the shaft 14 passing through the central, axial aperture 49 therein. The barrier plate is pressed against the smooth, upstream face of the upstream alignment disc 72. The hub 42, carrying the sector panels 44 to which the expansion flaps 46 are hinged, is next mounted on the shaft 14. The shaft 14 passes through the central, axial opening 43 in the hub 42. The hub 42 is mounted so that the expansion flaps 46 are on the upstream sides of the sector panels 44.

A flat spacing disc 80 is next mounted on the shaft 14. The spacing disc 80 has a thickness equal to the thickness of the expansion flaps 46 and an outer diameter that does not extend beyond the perimeter of the hub 42. The shaft 14 extends through the central, axial opening 81 in the spacing disc 80. The disc-shaped backing seal 50 is next mounted adjacent the spacing disc 80 with the shaft 14 extending through the central, axial opening 53 in the disc-shaped backing seal 50. Next, a disc-shaped reinforcement plate 82 having an outer peripheral diameter equal to the distance of the eight sides of the hub 42 from the axis of the shaft 14 is mounted on the shaft 14. The second, upstream end 18 of the shaft 14 extends through the central, axial opening 83 in the reinforcement disc 82. Two extra heavy nuts 84 are then threaded onto the second, upstream end 18 of the shaft 14 and then tightened.

When the cutting tool 10 is assembled, the cutting disc 22 is held at a fixed, predetermined distance of separation from the propulsion unit 40 by the reinforcement tube 70 from the inside of the structure. The nuts 34 and 84 at the opposite ends of the shaft 14 press the cutting unit 22 and the propulsion unit 40 toward the reinforcement tube 70 and clamp them at fixed positions on the shaft 14.

The pipeline 12, having an interior bounded by a cylindrical annular wall 13 and upon which clogging deposits 67 have formed, is cleaned by utilizing the pipeline cleaning tool 10. The cleaning operation is performed by forming openings in the pipeline 12 at both ends of a section of the pipeline 12 to provide access to the interior thereof. These ends and their respective openings are indicated generally at 86 and 88 in FIG. 2. The end 86 may be considered to be the upstream end while the end 88 is the downstream end.

The pipeline cleaning tool 10 is then inserted into the interior of the section of pipeline 12 at the opening in the upstream end thereof so that the upstream faces of the sector panels 44 face the upstream end 86 of the pipeline section at which the tool 10 is inserted. Water under pressure is then forced into the upstream end 86 of the section of pipeline 12. The water flows in the direction indicated by the directional arrows 20, thereby exerting a force against the backing seal 50. This force is transmitted to the upstream faces of the sector panels 44 and also acts against the expansion flaps 46. The hydraulic force tends to rotate the sector panels 44 outwardly towardly the annular wall 13 of the pipeline 12. The hydraulic force also tends to press the sector-shaped leaves of the backing seal disc 50 against the upstream faces of both the sector panels 44 and the expansion flaps 46, and also presses the expansion flaps 46 into intimate contact with the upstream faces of the sector panels 44 to the extent that the expansion flaps 46 overlap those faces. The fluid force thereby tends to restrict fluid flow past the propulsion unit 40, thus forming a pressure differential on opposite sides of the obstruction formed by the combined structure of the backing seal 50, the hub 42, the sector panels 44, and the expansion flaps 46.

The pressure differential created across the propulsion unit 40 propels the pipe cleaning tool 10 toward the other, downstream end 88 of the section of pipeline 12. As the cleaning tool 10 travels downstream, the teeth 26 of the cutting unit 22 dislodge the clogging deposits 67 from the annular wall 13 of the section of pipeline 12. This removal of the deposits 67 is aided by the blades 32 which split and crush the deposit material 67 radially inwardly toward the unclogged center opening 68 of the section of pipeline 12. The water that does flow pasts the propulsion unit 40 travels through the fluid passage openings 66 in the cutting disc 22 and about the periphery of the cutting disc 22 to carry the broken-up particulate matter from the deposits 67 to the downstream end 88 of the section of pipeline 12 in advance of the pipeline cleaning tool 10. Eventually, the pipeline cleaning tool 10 emerges from the section of pipeline 12 at the downstream end 88 thereof. The pipeline cleaning tool 10 is thereupon removed from the opening at the downstream end 88 of the section of pipeline 12.

Depending upon the resistence offered to the cutting disc 22, the section of pipeline 12 may be cleaned by a single passage of the pipeline cleaning tool 10 therethrough. In some cases a single passage of the pipeline cleaning tool 10 through the section of pipeline 12 will be sufficient to remove virtually all of the deposits 67. In other situations where the adhesion of the deposits 67 to the interior wall 13 of the section of pipeline 12 is particularly strong, several passes of the pipeline cleaning tool 10 through the section of pipeline 12 may be required.

In those situations, where the deposits 67 are quite hard and firmly adhere to the interior pipeline wall 13, it may be necessary to utilize cutting discs 22 of increasing diameter with successive passes of the tool 10 through the section of pipeline 12 in order to increase the distance at which the teeth 26 are held from the support shaft 14 with successive passages of the pipeline cleaning tool 10 through the section of pipeline 12. In cases such as this a cutting disc having a diameter only slightly greater than the unclogged opening 68 may be utilized first. Once the cleaning unit 10 has been passed through the section of pipeline 12, the first and smallest cutting disc is removed from the shaft 14 and replaced with a larger diameter cutting disc. Several cutting discs of increasing diameter may be utilized in sequence. However, the components of the propulsion unit 40 do not need to be exchanged, since the propulsion unit 40 folds radially inwardly from a maximum outer diameter of nearly twenty inches to a diameter as small as about thirteen and three-quarter inches.

The use of the propulsion unit 40 vastly decreases both the time, expense, and water pressure required to clean a section of pipeline 12. For example, the pipeline cleaning tool 10 depicted in FIGS. 1–7, requires a water pressure of only about one hundred twenty to one hundred thirty-five pounds per square inch for propulsion through a twenty inch diameter section of pipeline three thousand feet long.

Figure 8:
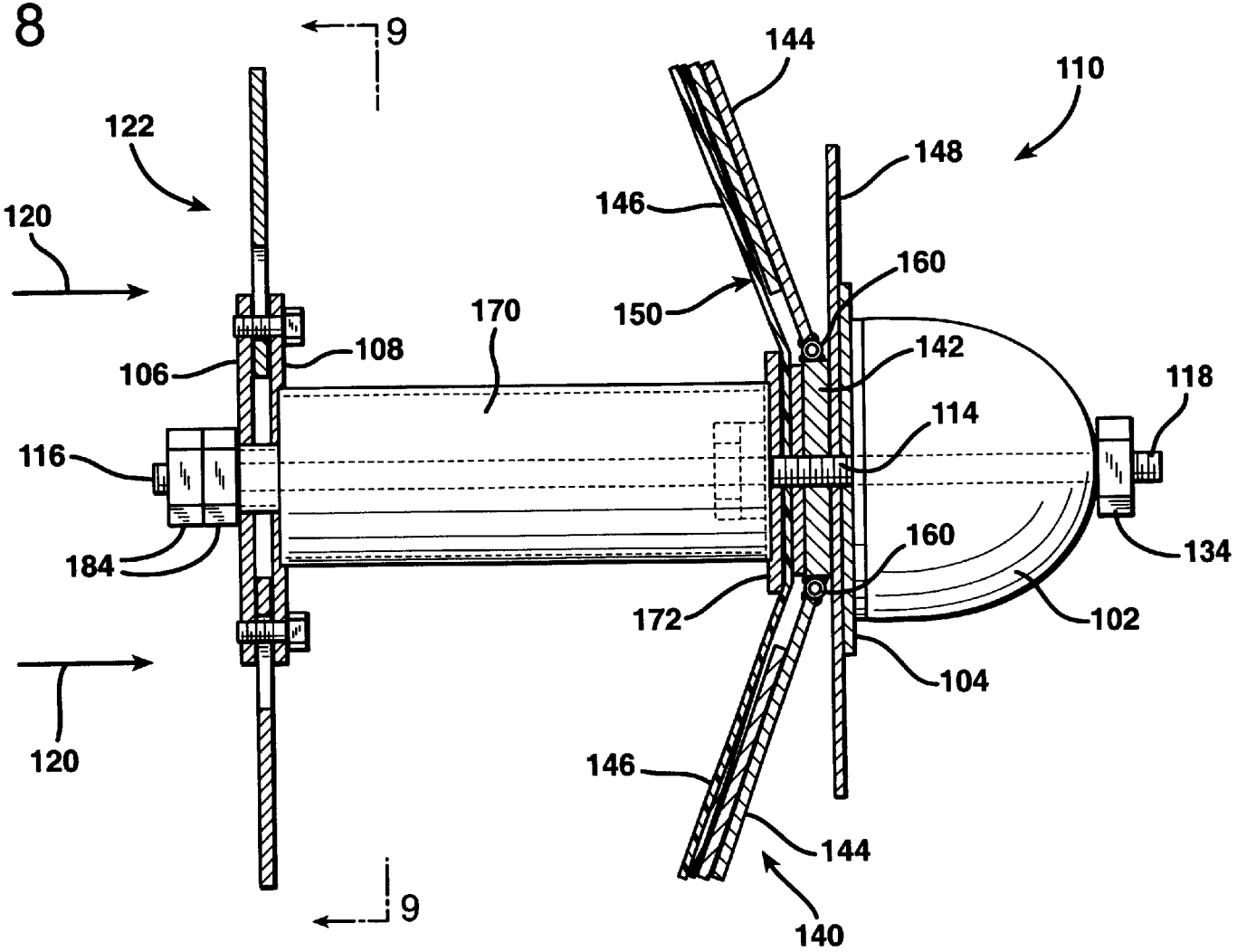
FIG. 8 is a is a side elevational view illustrating an alternative embodiment of a pipeline cleaning tool according to the invention.
Figure 9:
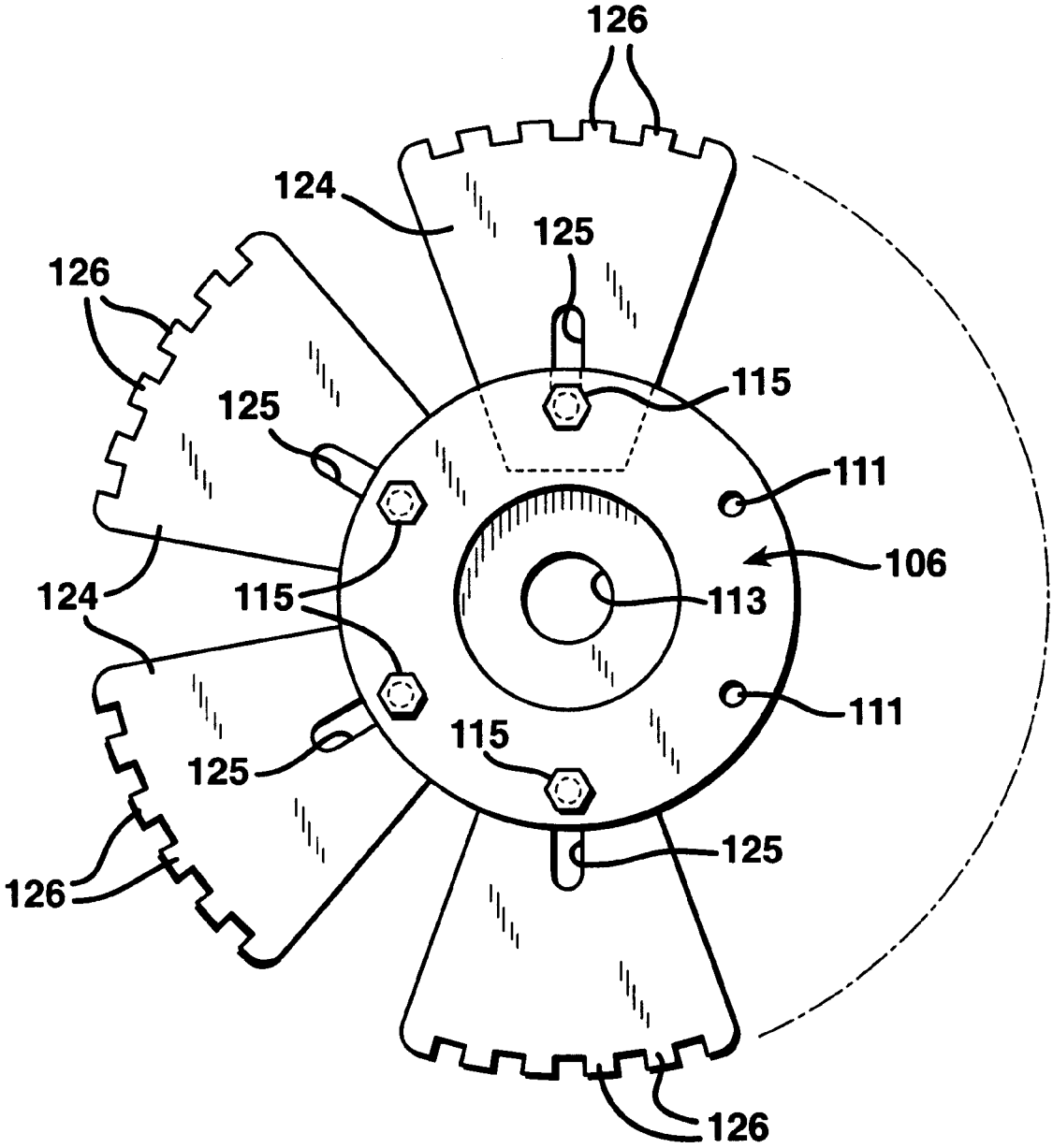
FIG. 9 is a transverse sectional view taken along the lines 9—9 of FIG. 8 showing the cutting unit of the tool in isolation.

FIGS. 8 and 9 illustrate an alternative embodiment of the invention. As shown in FIG. 8, the first, or upstream end, 116 of the pipeline cleaning tool 110 has a cutting unit 122 mounted thereto, while the second, or downstream, end 118 of the threaded shaft 114 bears the propulsion unit 140. The cutting unit 122 of the pipeline cleaning tool 110 has radially outwardly projecting teeth 126 about its periphery, but also has an adjustable cutter mounting support that varies the distance that the teeth 126 project outwardly from the elongated support shaft 114, as illustrated in FIG. 9.

The embodiment of the pipeline cleaning tool 110 illustrated in FIG. 8 may be constructed to clean pipelines of the same or different sizes as the pipeline 12 illustrated in FIG. 2. By way of example, the pipeline cleaning tool 110 may be designed for use in cleaning a pipeline having an inner diameter of 14 inches. In such an embodiment the threaded shaft 114 may be a one and one-eighth inch diameter B7 stud having a length equal to one and one-half times the pipe diameter. That is, the shaft 114 may about twenty-one inches in length.

The propulsion unit 140 of the pipeline cleaning tool 110 operates in the same way as the propulsion unit 40 and the components of the propulsion unit 140 and associated elements have the same structural configuration as the components of the propulsion unit 40 and associated elements in the embodiment of FIGS. 1–7. That is, the propulsion unit 140 is comprised of a hub 142, sector panels 144 having short, linear edges hinged to the hub 142, and expansion flaps 146. A barrier plate 148 is located downstream from the hub 142, and a backing seal 150 with radial slits defined therein is located upstream from the hub 142. The components of the propulsion unit 140 illustrated in FIG. 8 perform the same functions and interact with each other in the same manner as the corresponding propulsion unit components depicted and described in connection with the cleaning tool 10 shown in FIGS. 1–7. The propulsion unit 140 performs the same function and operates in the same manner as the propulsion unit 40 of the pipeline cleaning tool 10.

In the embodiment described in conjunction with FIGS. 8 and 9 the components are scaled down in size for use in a smaller diameter pipe. For a smaller diameter pipe it is economically advantageous to provide the propulsion unit 140 with fewer sector panels 144 than in the embodiment of FIGS. 1–7. More specifically, the hub 142 has a hexagonal shape, so that the propulsion unit 140 includes six sector panels 144 independently hinged by linear hinges 160 about the periphery of the hub 142. Each of the sector panels 144 thereby rotates relative to the hub 142 about an axis of rotation that lies tangent to an imaginary circle circumscribed within and touching the center of each side of the outer perimeter of the hub 142.

The propulsion unit 140 also includes six different expansion flaps 146, each of which is hinged to a first side edge of a separate one of the sector panels 144. The disc-shaped backing seal 150 has six radial slits defined in its structure extending radially inwardly from its perimeter and terminating about three inches short of the shaft 114.

The primary difference between the propulsion unit 140 and the propulsion unit 40, other than the different number of sector panels and the smaller outer diameter, is that the propulsion unit 140 is located at the second, downstream end 118 of the shaft 114. As a consequence, the propulsion unit 140 pulls the cleaning tool 110 through a pipeline, as opposed to the propulsion unit 40 in the embodiments of FIGS. 1–7 which pushes the cleaning tool 10 through the pipeline 12.

The propulsion unit 140 is mounted some distance upstream from the downstream extremity of the second end 118 of the shaft 114. This rearward or upstream positioning of the propulsion unit 140 thereby accommodates a generally spherically-shaped nosepiece 102. The nosepiece 102 has a convex, generally hemispherical surface facing downstream and is formed of metal so as to enlarge a central opening through a pipeline clogged with built up deposits 67 on the pipeline wall 13 as illustrated in FIG. 1. An extra heavy nut 134 holds the nosepiece 102 in position pressed rearwardly in an upstream direction against a nosepiece base disc 104. The nosepiece base disc 104 in turn bears against the rotation limiting disc 148.

The cutting unit 122 of the pipeline cleaning tool 110 differs significantly from the cutting unit 22 employed in the pipeline cleaning tool 10. More specifically, the cutting unit 122 is comprised of a pair of cutting element mounting discs 106 and 108, which are mounted coaxially relative to the support shaft 114 at the first, upstream end 116 thereof. Each of the cutting element mounting discs 106 and 108 has a plurality of openings 111 defined about its periphery at equally spaced intervals. In the embodiment shown in FIGS. 8–9 there are six mounting element openings 111 defined through each of the cutter element mounting discs 106 and 108. The mounting openings 111 are radially and longitudinally aligned with each other. Each of the cutting element mounting discs 106 and 108 also has a central, axial opening 113 that accommodates passage of the support shaft 114 therethrough.

The cutting unit 122 is further comprised of a plurality of flat cutting elements 124 which are located between the mounting discs 106 and 108 and which extend radially outwardly therefrom. Each of the cutting elements 124 is formed as a flat, sector-shaped solid steel plate having an outer periphery with cutting teeth 126 defined thereon. Each of the sector-shaped cutting elements 124 also has a narrower, radially inner end with a radially elongated mounting opening 125 defined therethrough. Each of the mounting openings 125 is formed as an elongated slot, closed at both ends.

The cutting unit 122 also includes a bolt 115 for each of the cutting element plates 124. Each bolt 115 has an externally threaded shank that projects through a smooth rimmed opening in the downstream cutter element mounting disc 108 and is threadably engaged in the internally tapped openings 111 in the cutter element mounting disc 106. Together the cutter element mounting discs 106 and 108, the elongated slots 125, and the bolts 115 form an adjustment mechanism that allows the radial distance at which the teeth 126 are carried. from the axis of the shaft 114 to be selectively and adjustably varied.

To adjust the distance of projection of the teeth 126 from the shaft 114, the bolts 115 are loosened to allow the flat, sector-shaped cutting element plates 124 be adjusted in their radial distance of projection from the shaft 114. The limits of adjustment are defined by the lengths of the oblong slots 125. Once the radial distance of extension of the teeth 126 from the shaft 114 has been selected, the bolts 115 are retightened, thereby firmly clamping the sector-shaped cutting element plates 124 projecting radially outwardly from between the cutting element mounting discs 106 and 108, as illustrated in FIGS. 8 and 9.

As in the pipeline cleaning tool 10, there is a reinforcement tube 170 mounted coaxially about the support shaft 114. The reinforcement tube 170 is held in coaxial alignment relative to the shaft 114 by an annular groove cut into the downstream face of the downstream cutter element mounting disc 108 at one end and a corresponding annular groove in the upstream face of a steel alignment disc 172 at the opposite end of the tube 170. The overall length of the tube 170 may, for example, be about twelve inches. The tube 170 may be a standard wall stainless steel pipe having an inner diameter of three inches and a wall thickness of about one-eighth of an inch.

The pipeline cleaning tool 110 is utilized in essentially the same manner as the pipeline cleaning tool 10. That is, a pipeline section to be cleaned is opened at both ends and the pipeline cleaning tool 110 is inserted into the upstream end of the pipeline section. The second, or downstream, end 118 of the pipeline cleaning tool 110 is first inserted into the open, upstream end of the pipeline section, and the tool 110 is pushed into the pipeline section to the cleaned. Water at a pressure of between one hundred and one hundred thirty-five pounds per square inch is then forced into the upstream end of the pipeline and acts in the direction indicated by the directional arrows 120 from the upstream end of the pipeline section toward the downstream end thereof.

The water passes between the sector-shaped cutting elements 124 of the cutting unit 122, but acts against the obstruction formed by the propulsion unit 140 to create a pressure differential across the backing seal 150 in the manner previously described. Like the sector panels 44, the sector panels 144 are capable of folding inwardly about the hinges 160 from an orientation substantially coplanar with the hub 142, as limited by the rotation limiting barrier disc 148, back toward the shaft 114 in an upstream direction if forced rearwardly by contact with either the interior wall of the pipeline section to be cleaned, or by contact with deposits on that wall.

The sector panels 144 of the propulsion unit 140 fold in toward the shaft 114 in response to contact with built up deposits on the interior pipeline wall despite the fluid pressure applied in the direction of the directional arrows 120. This water pressure acts against the upstream surface of the flexible, water impervious, disc-shaped backing seal 150 thereby flattening the six sectors of the seal 150 against the underlying upstream faces of the sector panels 144 and the expansion flaps 146 partially overlying the sector panels 144.

Since the outer peripheries of the backing seal 150, the sector panels 144, and the expansion flaps 146 contact either the inner wall of the pipeline or inner surface of the material built up on that inner wall, a pressure differential is formed across the propulsion unit 140. That is, the water pressure acting against the upstream face of the backing seal 150 is greater than the water pressure flowing past the nosepiece 102. As a result, the pressure differential created across the propulsion unit 140 propels the pipeline cleaning tool 110 longitudinally along the pipeline until it emerges from the downstream end thereof. As the teeth 126 are pulled through the accumulated material built up on the interior wall of the pipeline, that material is broken up and carried downstream by that portion of the water which flows past the propulsion unit 140.

If the material build up on the pipeline wall is not too thick, or if it can be dislodged from the pipeline wall without an application of excessive hydraulic force, it may well be possible to clean a section of pipeline with a single passage of the pipeline cleaning tool 140 through the pipeline section to be cleaned. Where the material built up is thicker or when that material adheres to the pipeline wall more tenaciously, it may be necessary to dislodge the material in stages. That is, the sector-shaped cutting plates 124 may be initially adjusted to protrude radially outwardly a relatively short distance from the shaft 114.

With each successive passage of the pipeline cleaning tool 110 through the pipeline section to be cleaned, the bolts 115 are loosened and the cutting element plates 124 are pulled radially outwardly from the center openings 113 in the cutter element mounting discs 106 and 108 an incremental distance before retightening the bolts 115. Thus, with each passage of the pipeline cleaning tool 110 through the pipeline section, a larger and larger diameter bore is defined through the material accumulated on the pipeline wall, until eventually the teeth 126 project radially almost to the pipeline wall and substantially all of the material has been removed.

The pipeline cleaning tool 110 is advantageous due to the ability to quickly and easily adjust the radial extent of projection of the teeth 126 from the support shaft 114. This adjustment may be performed for all of the cutting elements 124 within a matter of only about ten minutes. Thus, the pipeline cleaning tool 110 may be rapidly redeployed in successive passes through the section of pipeline to be cleaned.

Undoubtedly, numerous variations and modifications of the invention will become readily apparent to those familiar with pipeline cleaning tools. For example, numerous different adjustment devices may be utilized in place of the elongated slots 125 and clamping bolts 115 and mounting discs 106 and 108 shown. For example, an adjustable cam mechanism could be employed to force the teeth 126 radially outwardly from the shaft 114 to the extent desired. Also, different stiffening systems can be employed in place of the stiffening tubes 70 and 170. By way of example, spacer posts could be disposed radially about the central support shafts at selected angular intervals from each other. Accordingly, the scope of the invention should not be construed as limited to the specific embodiments illustrated and described.

I claim:

1. A pipeline cleaning tool comprising:

an elongated support member having opposing first and second ends, a rigid cutting unit having a periphery secured to said support member proximate said first end thereof and projecting radially outwardly from said support member, and a folding propulsion assembly including: a hub secured to said support member proximate said second end thereof and having an outer periphery; a plurality of sector panels arranged about said periphery of said hub and hinged separately thereto for rotation independently of each other about axes tangentially oriented relative to said periphery of said hub, wherein each of said sector panels has opposing upstream and downstream faces and also first and second side edges that diverge radially outwardly from each other, whereby said sector panels fan radially outwardly from said periphery of said hub and define gaps therebetween; and an expansion flap is provided for each of said sector panels and said expansion flaps extend the lengths of said first side edges of said sector panels and are hinged thereto, whereby said expansion flaps bridge said gaps and overlap portions of said upstream faces of the sector panels immediately adjacent the sector panels to which they are hinged, a rotation limiting barrier anchored to said elongated support member to prevent rotation of said sector panels past said hub in one direction of rotation relative thereto and to permit free rotation of said sector panels relative to said hub in an opposite direction relative thereto, and a disc-shaped backing seal formed of a flexible, water-impervious material and anchored relative to said elongated support member on a side of said hub opposite said rotation limiting barrier.

2. A pipeline cleaning tool according to claim 1 wherein said elongated support member is comprised of a solid, externally threaded metal rod.

3. A pipeline cleaning tool according to claim 1 wherein said rigid cutting unit is comprised of a flat disc-shaped metal plate serrated at its periphery to form radially projecting cutting teeth.

4. A pipeline cleaning tool according to claim 3 wherein said disc-shaped metal plate has an upstream face and an opposite downstream face and further comprising a plurality of sharp projections protruding from said downstream face of said metal plate.

5. A pipeline cleaning tool according to claim 4 wherein said sharp projections are formed as thin, radially aligned, longitudinally projecting blades located on the periphery of said disc-shaped metal plate.

6. A pipeline cleaning tool according to claim 5 wherein said first end of said elongated member is located downstream from said second end of said elongated member.

7. A pipeline cleaning tool according to claim 6 further comprising a plurality of openings in said disc-shaped metal plate located proximate to said blades.

8. A pipeline cleaning tool according to claim 1 wherein said rotation limiting barrier is formed as a stiff disc positioned on said elongated support member immediately adjacent said hub and having a diameter greater than that of said hub.

9. A pipeline cleaning tool according to claim 1 wherein said elongated support mechanism includes a central shaft upon which said hub and said cutting unit are mounted, and a cylindrical reinforcement tube held in rigid, coaxial alignment concentrically about said shaft and extending longitudinally between said cutting unit and said propulsion assembly.

10. A pipeline cleaning tool according to claim 1 in which said cutting unit has an adjustable cutter mounting support that varies the distance that said cutting teeth project outwardly from said elongated support member.

11. A pipeline cleaning tool according to claim 1 wherein said cutting unit is comprised of a pair of cutting element mounting discs mounted coaxially relative to said support member, each of said cutting element mounting discs having a plurality of angularly spaced mounting openings defined therethrough near its periphery, wherein said mounting openings in said mounting discs are radially and longitudinally aligned with each other, and further comprising a plurality of flat cutting elements located between said mounting discs and projecting radially outwardly therefrom, each cutting element having an outer arcuate periphery with said cutting teeth defined thereon and an inner end with a radially elongated mounting opening defined therethrough, and clamping bolts extending through said mounting openings to hold said cutting elements fly between said mounting discs so as to project radially outwardly therefrom an adjustable selected distance from said elongated support member.

12. A pipeline cleaning tool according to claim 11 wherein each of said cutting elements is formed as a flat, sector-shaped steel plate.

13. A pipeline cleaning tool according to claim 12 wherein said first end of said elongated support member is an upstream end and said second end of said elongated support member is a downstream end.

14. A pipeline cleaning tool according to claim 13 further including a nose piece located on said second end of said elongated support member and having a convex surface facing in a downstream direction away from said cutting unit.

15. A pipeline cleaning tool comprising:

an elongated central shaft having opposing first and second ends, a rigid cutting unit secured proximate said first end of said shaft and extending radially outwardly from said shaft, and a propulsion unit including: a solid hub secured proximate said second end of said shaft; a plurality of sector panels projecting radially outwardly from said hub, said sector panels being independently hinged to said hub for rotation about axes tangential to said hub and wherein each of said sector panels has radially outwardly diverging first and second side edges, and a separate, expansion flap for each of said sector panels wherein said expansion flaps are hinged for independent rotation along said first side edges of said sector panels; and a rotation barrier anchored to said shaft at said hub and projecting outwardly whereby said rotation barrier limits rotation of said sector panels relative to said hub toward only one of said ends of said shaft and said expansion flaps rotate relative to said first side edges of said sector panels and slide in overlapping contact with adjacent sector panels when said sector panels rotate toward said shaft and away from said one of said ends of said shaft, and a backing seal formed of a sheet of flexible, water-impervious material mounted on said central shaft proximate said hub and on a side thereof opposite said rotation barrier, and said backing seal has radial slits defined therein, whereby together said hub, said sector panels, said expansion flaps and said backing seal present a transverse obstruction to fluid flow past said shaft in a single longitudinal direction relative thereto.

16. A pipeline cleaning tool according to claim 15 in which said rigid cutting unit has cutting teeth at its radial periphery that project radially from said cutting unit periphery, and said cutting unit includes an adjustment mechanism for varying the distance at which said teeth are held from said central shaft.

17. A pipeline cleaning tool according to claim 15 in which said first end of said central shaft is an upstream end and said second end of said central shaft is a downstream end.

18. A pipeline cleaning tool according to claim 15 in which said first end of said central shaft is a downstream end and said second end of said central shaft is an upstream end.

19. A method of cleaning a section of pipeline having an interior bounded by a cylindrical annular wall upon which clogging deposits have formed, utilizing a pipeline cleaning tool having:

an elongated support member having opposing first and second ends, a rigid cutting unit having a cutting periphery thereon secured to said support member proximate said first end thereof and projecting radially outwardly from said support member, and a folding propulsion assembly including: a hub secured relative to said support member proximate said second end thereof; a plurality of sector panels arranged about the periphery of said hub and hinged separately thereto for rotation independently of each other about axes tangentially oriented relative to said periphery of said hub, wherein each of said sector panels has opposing upstream and downstream faces and first and second side edges that diverge radially outwardly from each other, whereby said sector panels fan radially outwardly from said hub and define gaps therebetween; and an expansion flap is provided for each of said sector panels and said expansion flaps extend the lengths of said first side edges of said sector panels and are hinged thereto, whereby said expansion flaps bridge said gaps and overlap said upstream faces of the sector panels immediately adjacent the sector panels to which they are hinged, and a rotation limiting barrier anchored to said elongated support member to prevent rotation of said sector panels past said hub in one direction of rotation relative thereto and to permit free rotation of said sector panels relative to said hub in an opposite direction relative thereto, and a backing seal formed of a flexible, water-impervious material anchored relative to said elongated support member on a side of said hub opposite said rotation limiting barrier, comprising the steps of:

forming openings in said pipeline at both ends of said section of pipeline to provide access to said interior thereof, inserting said pipeline cleaning tool into said interior of said pipeline at one of said openings at one of said ends of said section of pipeline so that said upstream faces of said sector panels face said one of said ends of said pipeline section, forcing fluid under pressure into said one of said ends of said section of pipeline so that said fluid exerts a force against said upstream faces of said sector panels and against said expansion flaps, thereby tending to rotate said sector panels outwardly toward said annular wall of said pipeline section to form a pressure differential on opposite sides of said backing seal which propels said pipe cleaning tool toward said other end of said pipeline section, whereby said cutting unit dislodges said clogging deposits from said annular wall of said pipeline section, removing said pipeline cleaning tool from said other of said openings in said pipeline, and closing said openings in said pipeline.

20. A method according to claim 19 wherein said cutting unit has radially projecting teeth located about its periphery and an adjustment mechanism for varying the radial distance at which said teeth are held from said support member, and further comprising inserting said pipeline cleaning tool in said pipeline and forcing fluid under pressure into said one end of said pipeline and removing said pipeline cleaning tool from said other of said openings in said pipeline a plurality of successive times, whereby said pipeline cleaning tool makes successive passes through said section of pipeline, and increasing said distance at which said teeth are held from said support member with successive passes of said pipe cleaning tool through said section of pipeline.

* * * * *